United States Patent [19]

Brandolese

[11] Patent Number: 5,009,803

[45] Date of Patent: Apr. 23, 1991

[54] LUBRICANT FLUID FOR THE COLD-ROLLING OF STEEL

[75] Inventor: Ernesto Brandolese, Graffignana, Italy

[73] Assignee: Agip Petroli S.p.A., Rome, Italy

[21] Appl. No.: 506,816

[22] Filed: Apr. 10, 1990

[30] Foreign Application Priority Data

Apr. 18, 1989 [IT] Italy ..... 20191 A/89

[51] Int. Cl.[5] ..... C10M 173/00

[52] U.S. Cl. ..... 252/49.5; 252/56 S; 252/56 R; 72/42

[58] Field of Search ..... 252/49.5, 49.3, 56 S, 252/56 R; 72/42

[56] References Cited

U.S. PATENT DOCUMENTS

| | | | |
|---|---|---|---|
| 2,673,185 | 3/1954 | Bartlett | 252/56 R |
| 2,758,975 | 8/1956 | Cottle et al. | 252/56 S |
| 4,746,448 | 5/1988 | Kenmochi et al. | 252/56 S |
| 4,801,391 | 1/1989 | Goldblatt et al. | 252/56 R |
| 4,889,648 | 12/1989 | Higaki et al. | 252/49.5 |

*Primary Examiner*—Jacqueline V. Howard

*Attorney, Agent, or Firm*—Oblon, Spivak, McClelland, Maier & Neustadt

[57] ABSTRACT

Lubricant fluids for the cold-rolling of steel, comprising one or more organic carbonates of general formula (I)

$$RO-\underset{\underset{O}{\|}}{C}-OR' \qquad (I)$$

where R and R', which can be identical or different, represent a $C_6$–$C_{30}$ linear or branched alkyl, cycloalkyl or cycloalkyl-alkyl radical, possibly mixed, in a quantity sufficient to provide the composition with the lubricant power necessary for the particular application, with a mineral oil base. These lubricant fluids can be conveniently used in the cold-rolling of any type of steel, either as whole oils or, after adding suitable quantities of emulsifiers, as oil concentrates for forming aqueous emulsions or microemulsions. In addition to possessing all the typical characteristics of rolling fluids, they are also able to minimize the formation of carbon residues and deposits in the subsequent annealing process.

8 Claims, 2 Drawing Sheets

LUBRICANT FLUID FOR THE COLD-ROLLING OF STEEL

Figure 1A:
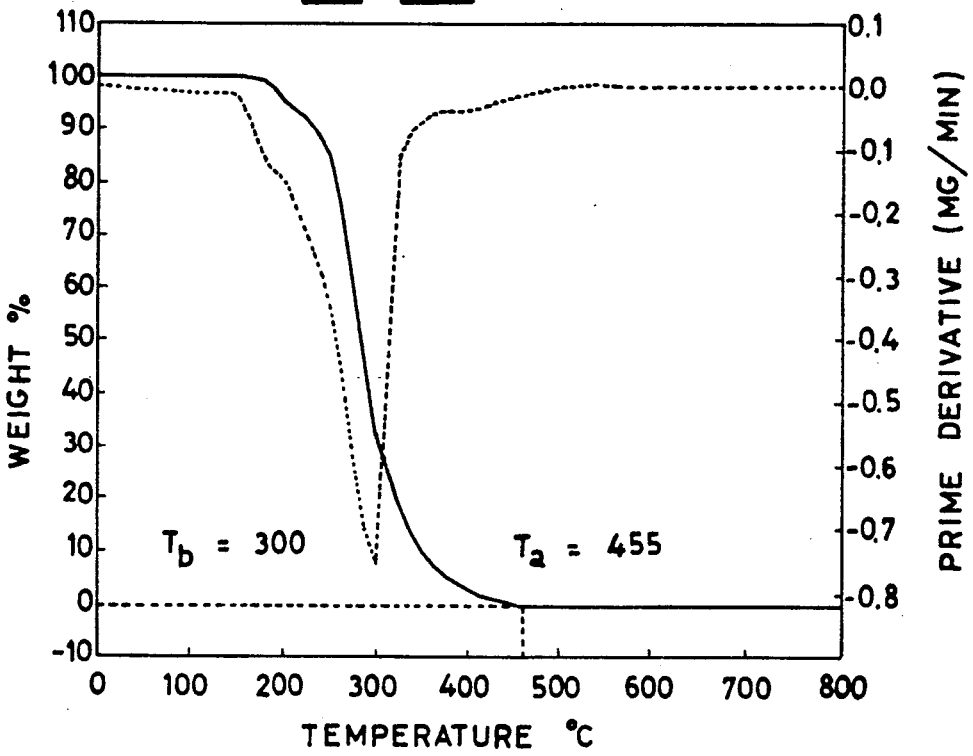

This invention relates to the use of alkyl or cycloalkyl esters of carbonic acid in the preparation of lubricant fluids suitable for the cold-rolling of steel, and the resultant lubricant fluids containing such carbonic esters.

The choice of the lubricant fluid in steel rolling, and in particular in cold rolling processes, has become extremely critical with the advent of high-speed rolling mills. There is more than one reason for feeding a lubricant fluid between the material to be rolled and the rolls which produce the plastic deformation (friction reduction, wear reduction, obtaining the required surface finish etc.), and in choosing the most suitable lubricant fluid the relative importance of these factors must be carefully evaluated on the basis of the process used, the material to be rolled and the required product.

Of the lubricant fluids suitable for this particular process those currently most widely used are natural fats and synthetic fatty esters, either as such or preferably diluted in a mineral oil base. These lubricants are either used as such or, with the addition of suitable quantities of emulsifiers, are used to prepare aqueous emulsions of varying concentration. Aqueous emulsions are used when the main factor is the control of temperature, whereas whole oils are preferred when it is the lubricant effect which is the most important or when the presence of water can create particular corrosion problems.

In selecting a suitable lubricant for the cold-rolling of steel another factor extremely important from the technical aspect must also be considered, namely that the lubricant must not stain the product. In this respect, if the required product is to have a shiny finish after cold-rolling or be subsequently coated, the lubricant used must after the high-temperature annealing leave no residues which can damage or ruin the appearance of the surface. The complete removal of the rolling oil before annealing using special cleaning or degreasing methods would be an obvious step, but this results in excessive production costs; in addition, if a strip with a too clean surface is annealed at high temperature, the adjacent turns of a coil can adhere to each other.

In normal practice it is therefore sought to reduce this problem as much as possible by removing the excess lubricant by rubbing or with air jets, and then allowing the remaining lubricant to evaporate either during a pause in the process immediately before annealing, or during the initial stages of annealing.

As complete lubricant removal is never obtained in this manner, it is clear why in the last twenty years various studies have been carried out directed to identifying and perfecting lubricant fluids suitable for the cold-rolling of steel which either solve or at least as far as possible reduce the problem of staining. Thus traditional animal or vegetable oil such as lard oil or palm oil, possibly mixed with mineral oil, has been superseded by a mixture of this latter with synthetic additives and in particular synthetic fatty esters, which have resulted in a reduction of the phenomenon. It has however now been found possible to prepare lubricant fluids suitable for the cold-rolling of steel which besides possessing all the typical characteristics of metal rolling fluids are also able to minimize the formation of carbon residues and deposits during subsequent annealing.

These lubricant fluids, which represent a first aspect of the present invention, comprise one or more organic carbonates of general formula (I)

$$RO-\underset{\underset{O}{\|}}{C}-OR' \qquad (I)$$

where R and R', which can be identical or different, represent a $C_6$–$C_{30}$ linear or branched alkyl, cycloalkyl or cycloalkyl-alkyl radical, possibly mixed, in a quantity sufficient to provide the composition with the lubricant power necessary for the particular application, with a mineral oil base.

In practice, this "sufficient quantity", expressed as a weight percentage of the total weight of the composition, is generally greater than 5%, preferably greater than 10% and more preferably greater than 15%.

The radicals R and R' indicated in formula (I) represent $C_6$–$C_{30}$ linear or branched alkyl, cycloalkyl or cycloalkyl-alkyl radicals, in which the radical carbon atom can be primary, secondary or tertiary.

Preferably, R and R' represent $C_6$–$C_{30}$ linear or branched alkyl radicals. More preferably, R and R' represent $C_{10}$–$C_{20}$ linear or branched alkyl radicals.

The esters of carbonic acid with higher aliphatic or cycloaliphatic alcohols of formula (I) are known compounds, and are easily prepared either by transesterification of lower alkyl carbonates such as dimethylcarbonate or diethylcarbonate with higher alcohols or mixtures of higher alcohols, in the presence of suitable transesterification catalysts, or by reacting the higher alcohol, or alcohol mixture, with phosgene at high temperature preferably in the presence of an organic or inorganic base. A lubricant effect of higher alcohol carbonic esters is known from U.S. Pat. No. 2,758,975, which claims a particular composition of organic carbonates and tricresylphosphate, and from European patent application No. 89,709, which relates to the use of organic carbonates in formulating lubricants for internal combustion engines and/or industrial machines.

It has however now been found that the lubricant characteristics of these organic carbonates can also be used in the specific field of lubrication in the rolling of steel, which as stated differs considerably from conventional lubrication both because of the more complex objectives which are set and because of the type of deformation involved (plastic rather than only elastic). It has also been found that the thermal stability characteristics of the organic carbonates of formula (I) and their volatility are such as to make these compounds particularly suitable for their use in the cold rolling of steel. In particular, thermogravimetric analysis has shown that the organic carbonates of formula (I) have good thermal stability at the temperature peaks attainable during rolling (250°–270° C.) and are able to evaporate completely at temperatures much lower than the standard annealing temperatures (which are typically between 650° and 730° C.).

These compounds also have the peculiar property of evaporating without excessive decomposition within a relatively narrow temperature range.

A lubricant fluid consisting of one or more carbonates of formula (I) possibly mixed with a mineral oil base, which can be of paraffinic, aromatic or naphthenic type, can conveniently be used whole for the cold lubrication of any type of steel, from normal steels of low carbon content to stainless steels. Moreover, it can be used, upon addition thereto of appropriate quantities of emulsifying agents, as an oily concentrate for the formation of microemulsions, or of a minor proportion of such a concentrate in a greater proportion of water, in order to form stable emulsions. In preparing these emulsions or microemulsions, the preparation of which is conventional, it is preferable to use mixtures of one or more carbonates of formula (I) with a mineral oil base containing suitable emulsifiers in a quantity sufficient to allow the aqueous emulsion or microemulsion to be prepared at the required concentration.

Suitable emulsifiers are all the normal ashless nonionic or anionic surfactants such as polyoxyethylenic ethers and esters, and in particular ethoxylated alkylphenols such as those marketed by Hoechst under the name of Emulsogen® or Sapogenat®, or those marketed by Huls under the name of Marlophen®.

Preferably, the organic carbonate (of formula I) content of this oil concentrate is between 5 and 65%, and more preferably between 10 and 50%.

If desired, the emulsions or microemulsions can also contain other conventional additives such as anticorrosion agents, antiwear agents etc., as known in this field.

Generally the concentration of the oil phase in water varies between 1 and 5% and is preferably around 2–3%.

In particular, it is preferred to use the aqueous emulsion or microemulsion obtained in this manner for steel lubrication and rolling in four-high or tandem rolling mills, whereas the whole oil is preferred for cold rolling in reversible rolling mills of Sendzimir type.

The following examples are provided merely for the purpose of describing some lubricant compositions representative of the present invention in greater detail, and are in no way to be considered as setting a limitation on the scope of the invention.

EXAMPLE 1

Synthesis of Carbonic Esters of Formula (I)

General Method

The synthesis apparatus consists of a jacketed three-neck flask temperature-controlled by an externally circulating fluid, surmounted by a distillation column comprising perforated plates and a liquid dividing head, and fitted with a magnetic stirrer and thermometer.

The low-boiling alcohol carbonate (dimethyl carbonate), an at least stoichiometric quantity of the higher alcohol or mixture of higher alcohols, i.e. double the moles of the lower alcohol carbonate, and preferably in excess over the stoichiometric, plus the transesterification catalyst in the form of an organic or inorganic compound of strongly basic character are placed in the flask. The reaction is conducted in an inert atmosphere, heating the reaction mixture to boiling point and removing as overheads the low-boiling alcohol which forms. In some cases the reaction was conducted in the presence of an inert solvent able to form a minimum azeotrope with the low-boiling alcohol so as to facilitate its removal by distillation. On termination of the reaction the catalyst can be removed (by washing with water, filtration or neutralization) and the reaction product can be recovered by distilling off the unwanted by-products and any unreacted higher alcohols in excess.

In this manner, starting from the following mixtures of suitable higher alcohols, the corresponding mixtures of organic carbonates (I) are obtained, their molecular weights being indicated in parentheses:

(A) a mixture of iso-decyl alcohols (342.6);
(B) n-decyl alcohol (342.6);
(C) a 50 wt % mixture of $C_{14}$–$C_{15}$ branched alcohols (468);
(D) a mixture of iso-tridecyl alcohols (50 wt %) and $C_{12}$–$C_{15}$ alcohols containing 40% of linear and 60% of branched (50 wt %) (430.2 mean);
(E) a mixture of $C_{12}$–$C_{15}$ oxo-alcohols (442.0 means).

EXAMPLE 2

A formulation is prepared consisting of 30% of the carbonic ester of Example (1A) in low-viscosity paraffinic mineral oil for use as a whole oil for steel rolling on a reversible Sendzimir rolling mill.

The lubricant power of this composition, evaluated by the Almen-Wieland machine test, was found to be 1850 kg, and the EP power evaluated by the four ball method according to ASTM D-2783 was 400 daN, with maximum no-seizure load of 80 daN.

EXAMPLE 3

A formulation is prepared consisting of 35% of the carbonic ester of Example (1B) in low-viscosity paraffinic mineral oil for use as a whole oil for steel rolling on a reversible Sendzimir rolling mill.

The lubricant power of this composition, evaluated by the Almen-Wieland machine test, was found to be 1900 kg, and the EP power evaluated by the four ball method was 420 daN, with maximum no-seizure load of 90 daN.

EXAMPLE 4

A transparent microemulsion of 2–3% of an oil phase in water is prepared, the oil phase consisting of 35% of the carbonic ester of Example (1C), 45% of paraffinic mineral oil and 20% of anionic emulsifiers of the ethoxylated alkylphenol class. This formulation is conveniently used for the cold-rolling of steel on tandem rolling mills. The lubricant power of this emulsion, evaluated by the Almen-Wieland machine test, was found to be 2750 kg, and the EP power evaluated by the four ball method was 110 daN, with maximum no-seizure load of 60 daN. The degree of cleanliness of the strips after rolling always exceeded 90% (Scotch test), and the carbon powder after annealing was an average of 2.5 mg/m$^2$.

EXAMPLE 5

A milky emulsion of 2–3% of an oily phase in water is prepared, the oily phase consisting of 45% of the carbonic ester of Example (1D), 37% of paraffinic mineral oil and 18% of emulsifiers as in the preceding example. This formulation is conveniently used for the cold-rolling of steel on four-high rolling mills. The lubricant power of this emulsion, evaluated by the Almen-Wieland machine test, was found to be 1950 kg, and the EP power evaluated by the four ball method was 160 daN, with maximum no-seizure load of 75 daN. The degree of cleanliness of the strips after rolling always exceeded 90% (Scotch test), and the carbon powder after annealing was less than 4 mg/m$^2$.

The concentrated oil was subjected to thermogravimetric analysis before using the rolling mill to measure the oil weight loss as a function of temperature and thus determine both its evaporation rate and thermal stability. For this purpose, a small quantity of the oil placed in a platinum microcapsule connected to a balance is heated at a predetermined rate, then recording the weight variation as a function of temperature. During the experiment the first differential of the weight/temperature curve is calculated and recorded, to produce a curve which represents the evaporation rate of the substance.

The thermogram for this oil is shown in FIG. 1*a*. This graph shows that the temperature at which the entire oil disappears ($T_a$) is decidedly less than the steel annealing temperature (455° C. as against the general annealing temperature of between 650° and 730° C.), and that the temperature at which maximum evaporation rate is attained ($T_b$) is much higher than the temperature peaks reached during rolling (300° C. as against the 250°-270° C. reached during cold-rolling), thus demonstrating the good thermal stability at working temperatures of the carbonic ester contained in the emulsion.

EXAMPLE 6

The thermal stability of the carbonate mixture of Example 1E is evaluated by thermogravimetric analysis using the procedure described in the preceding example.

Figure 1B:
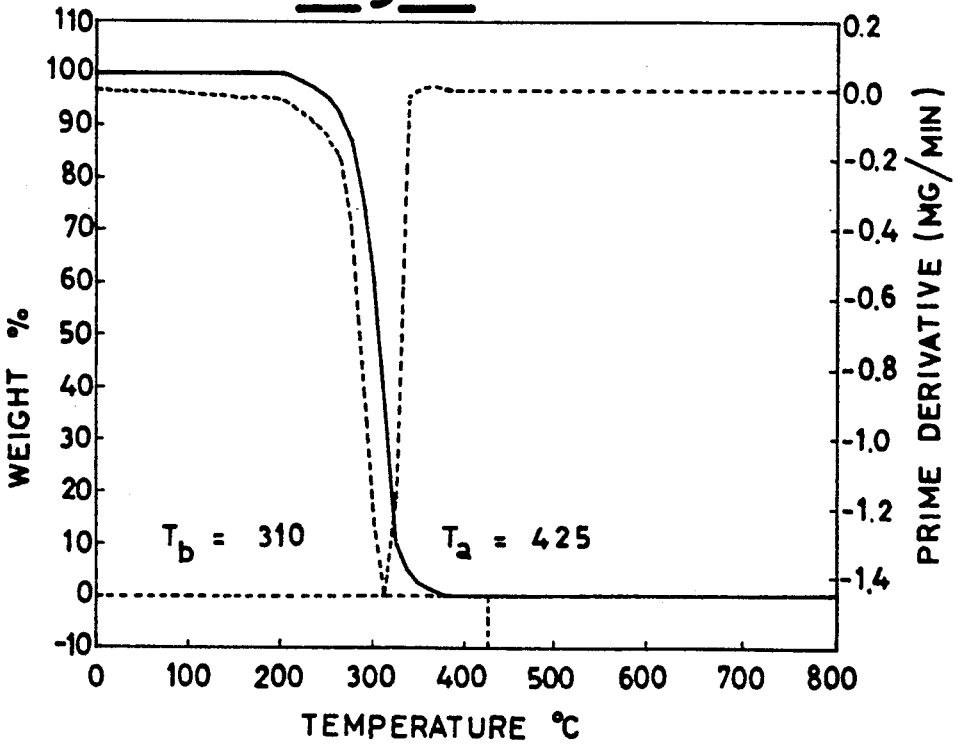

The relative thermogram is shown in FIG. 1*b*. It can again be seen that the $T_a$ (425° C.) is much less than the annealing temperature and that the $T_b$ (310° C.) is much higher than the temperature peaks reached in the cold rolling process.

EXAMPLES 7-8

Comparison

The thermal stability of conventional rolling lubricants is evaluated by thermogravimetric analysis using the procedure described in Example 5. The specific lubricants used are of the natural fatty ester class, particularly lard oil, and the synthetic fatty ester class, particularly oleates. The relative thermograms are shown in FIGS. 2*a* and 2*b* respectively.

It can be seen that the $T_b$ values are less in both cases (205° and 220° C.) than the temperature peaks reached in cold-rolling, which could imply partial decomposition of the lubricant during working. With regard to the $T_a$ values, for natural fatty esters (655° C.) it is in fact within the annealing temperature range, which implies the possibility of considerable carbon deposits forming on the surface of the material during passage, whereas for synthetic fatty esters, although not higher (520° C.) it is however fairly close to conventional annealing temperatures.

Figure 2A:
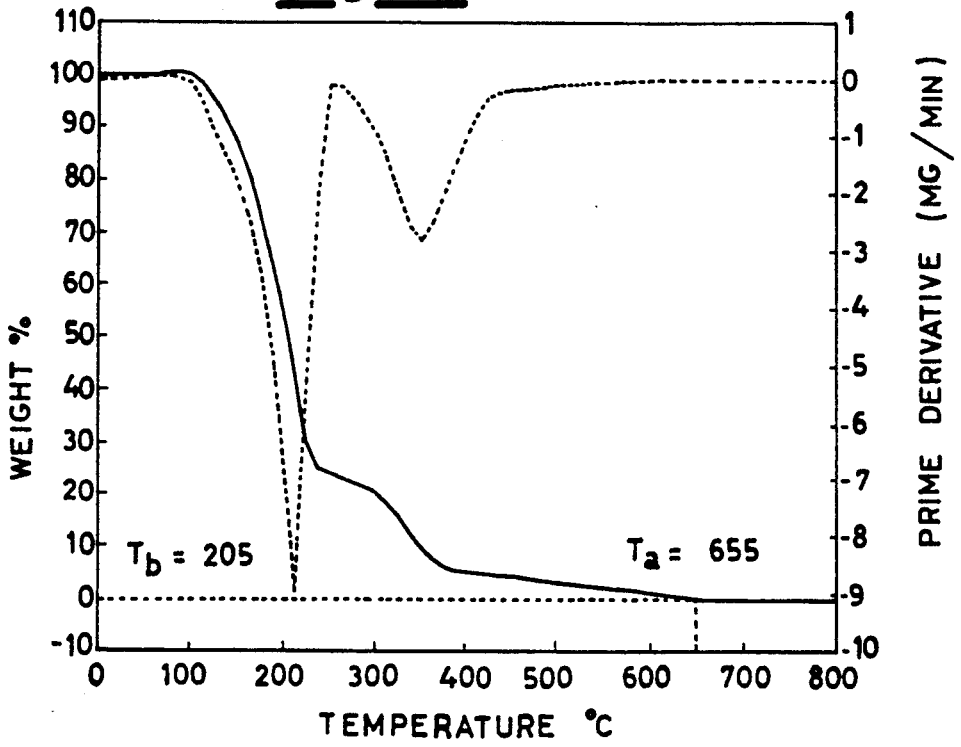
Figure 2B:
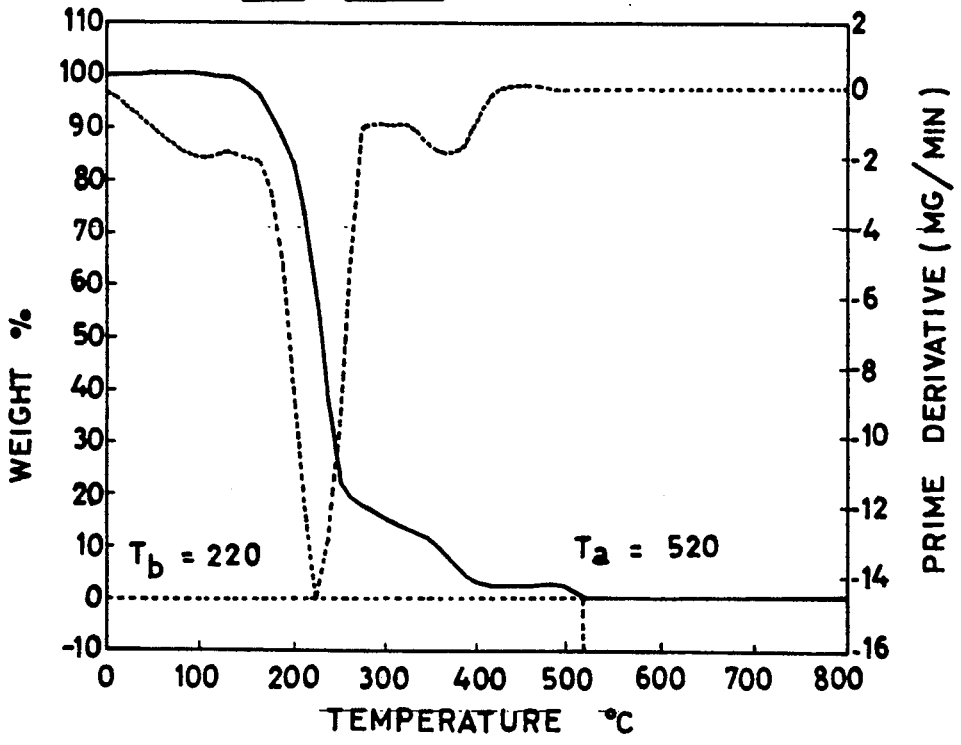

By comparing FIGS. 1*a* and 1*b* with FIGS. 2*a* and 2*b* it can also be seen that in the case of the carbonic esters there is only one maximum on the differentiated rate curve and that this is very narrow, whereas in the case of the natural or synthetic fatty esters there are two and of greater width.

I claim:

1. An emulsion of oil in water, comprising:

(a) an oil phase, comprising one or more organic carbonates of the general formula (I)

$$RO-\underset{\underset{O}{\|}}{C}-OR' \qquad (I)$$

wherein R and R', which may be the same or different, represent a $C_6$-$C_{30}$ linear or branched alkyl, cycloalkyl, or cycloalkyl-alkyl group; and at least one emulsifier selected from the group consisting of non-ionic and anionic surfactants; and (b) water;

wherein said oil phase is present in an amount of between 1 and 5 wt. %.

2. The emulsion of claim 1, wherein said oil phase is present in an amount of 2-3 wt. %.

3. An emulsion of oil in water, comprising:

(a) an oil phase comprising one or more organic carbonates of the general formula (I)

$$RO-\underset{\underset{O}{\|}}{C}-OR' \qquad (I)$$

wherein R and R', which may be the same or different, represent a $C_6$-$C_{30}$ linear or branched alkyl, cycloalkyl, or cycloalkyl-alkyl group; mineral oil; and at least one emulsifier selected from the group consisting of non-ionic and anionic surfactants; and (b) water;

wherein said oil phase is present in an amount of 1-5 wt. %.

4. The emulsion of claim 3, wherein said oil phase is present in an amount of 2-3 wt. %.

5. A method of cold-rolling steel, comprising cold-rolling steel while lubricating said steel with an emulsion, comprising:

(a) an oil phase, comprising one or more organic carbonates of the general formula (I)

$$RO-\underset{\underset{O}{\|}}{C}-OR' \qquad (I)$$

wherein R and R', which may be the same or different, represent a $C_6$-$C_{30}$ linear or branched alkyl, cycloalkyl, or cycloalkyl-alkyl group; and at least one emulsifier selected from the group consisting of non-ionic or anionic surfactants; and (b) water;

wherein said oil phase is present in an amount of between 1 and 5 wt. %.

6. The method of claim 5, wherein said oil phase is present in an amount of 2-3 wt. %.

7. A method for cold rolling steel, comprising: cold-rolling steel while lubricating said steel with an emulsion, comprising (a) an oil phase comprising one or more organic carbonates of the general formula (I)

$$RO-\underset{\underset{O}{\|}}{C}-OR' \qquad (I)$$

wherein R and R', which may be the same or different, represent a $C_6$-$C_{30}$ linear or branched alkyl, cycloalkyl, or cycloalkyl-alkyl group; mineral oil; and at least one emulsifier selected from the group consisting of non-ionic and anionic surfactants; and (b) water;

wherein said oil phase is present in an amount of 1-5 wt. %.

8. The method of claim 7, wherein said oil phase is present in an amount of 2-3 wt. %.

* * * * *